US008839533B2

(12) United States Patent
Runggaldier

(10) Patent No.: US 8,839,533 B2
(45) Date of Patent: Sep. 23, 2014

(54) SNOWGROOMER INCLUDING A WINCH ASSEMBLY TO AID HANDLING OF THE SNOWGROOMER ON STEEP SLOPES, AND METHOD OF OPERATING THE WINCH ASSEMBLY

(75) Inventor: Martin Runggaldier, St. Christina (IT)

(73) Assignee: Snowgrolic S.A.R.L., Luxembourg (LU)

( * ) Notice: Subject to any disclaimer, the term of this patent is extended or adjusted under 35 U.S.C. 154(b) by 532 days.

(21) Appl. No.: 13/201,256

(22) PCT Filed: Feb. 17, 2010

(86) PCT No.: PCT/IB2010/000299

§ 371 (c)(1),
(2), (4) Date: Oct. 24, 2011

(87) PCT Pub. No.: WO2010/095016

PCT Pub. Date: Aug. 26, 2010

(65) Prior Publication Data

US 2012/0030974 A1 Feb. 9, 2012

(30) Foreign Application Priority Data

Feb. 18, 2009 (IT) ..... MI2009A0215

(51) Int. Cl.
*A63C 19/10* (2006.01)
*E01H 4/02* (2006.01)
*B66D 1/38* (2006.01)

(52) U.S. Cl.
CPC ... *E01H 4/02* (2013.01); *B66D 1/38* (2013.01)
USPC ..... 37/219; 254/323

(58) Field of Classification Search
CPC ..... E01H 4/00; E01H 4/02; E01H 4/023; E01H 2004/00; E01H 2004/02; E01H 2004/026; B66D 1/505; B66D 1/60; B66D 1/38
USPC ..... 37/219; 254/323
See application file for complete search history.

(56) References Cited

U.S. PATENT DOCUMENTS 3,170,533 A 2/1965 Fewel et al.
3,227,295 A 1/1966 Hamilton et al.

(Continued)

FOREIGN PATENT DOCUMENTS

CA 2211050 1/1998
CA 2441650 4/2004

(Continued)

OTHER PUBLICATIONS

PistenBully 600 brochure, written by Kassbohrer Gelandefahrzeug AG, published in Mar. 2010.

(Continued)

*Primary Examiner* — Jamie L McGowan
(74) *Attorney, Agent, or Firm* — Neal, Gerber & Eisenberg LLP

(57) ABSTRACT

A snow groomer, equipped with a winch assembly to aid handling of the snow groomer on steep slopes, has a frame; a user interface; a control unit; and the winch assembly, which has a support structure fixed or connected to the frame, a drum that rotates with respect to the support structure about an axis, a cable fixed or connected at one end to the drum and wound about the drum, an actuator assembly for rotating the drum about the axis, and a sensor for determining the position of the drum about the axis; the control unit being configured to control the cable as a function of the position of the drum and the geometry of the drum.

17 Claims, 3 Drawing Sheets

(56) References Cited

U.S. PATENT DOCUMENTS

| | | | | |
|---|---|---|---|---|
| 3,386,778 | A | 6/1968 | Rymes | |
| 3,534,701 | A | 10/1970 | Hebert | |
| 3,692,132 | A | 9/1972 | Pollanen | |
| 3,763,944 | A | 10/1973 | Kaltenegger | |
| 4,087,135 | A | 5/1978 | Unruh | |
| 4,348,825 | A | 9/1982 | Bachler | |
| 4,458,954 | A | 7/1984 | Hass | |
| 4,458,955 | A | 7/1984 | Webb | |
| 4,500,139 | A | 2/1985 | Tucek | |
| 4,788,783 | A | 12/1988 | Bachler | |
| 5,062,493 | A | 11/1991 | Platter et al. | |
| 5,067,263 | A | 11/1991 | Pelletier | |
| 5,318,141 | A | 6/1994 | Hansen | |
| 6,155,363 | A | 12/2000 | Matsumoto et al. | |
| D449,252 | S | 10/2001 | Takeshita et al. | |
| 6,296,330 | B1 | 10/2001 | Hall | |
| 6,354,023 | B1 | 3/2002 | Trahan et al. | |
| 6,364,437 | B1 | 4/2002 | Phely | |
| 6,418,645 | B1 | 7/2002 | Hammerle et al. | |
| 6,637,134 | B2 | 10/2003 | Hammerle | |
| 6,810,609 | B2 | 11/2004 | Lassonde et al. | |
| 6,921,304 | B2 | 7/2005 | Hewitt | |
| 6,983,927 | B2 | 1/2006 | Pelletier et al. | |
| 7,165,758 | B2 * | 1/2007 | Kanzler | 254/323 |
| 7,299,569 | B2 * | 11/2007 | Kanzler | 37/221 |
| 7,464,699 | B2 | 12/2008 | Joppig et al. | |
| 7,530,547 | B2 | 5/2009 | Leitner et al. | |
| 8,201,349 | B2 * | 6/2012 | Kanzler et al. | 37/219 |
| 2002/0139013 | A1 | 10/2002 | Hammerle | |
| 2003/0051376 | A1 | 3/2003 | Lassonde et al. | |
| 2003/0159840 | A1 | 8/2003 | Schmidt, Jr. | |
| 2004/0069981 | A1 | 4/2004 | Pelletier et al. | |
| 2004/0144000 | A1 * | 7/2004 | Kanzler | 37/196 |
| 2005/0252592 | A1 | 11/2005 | Albright et al. | |
| 2005/0279980 | A1 | 12/2005 | Leitner et al. | |
| 2007/0130806 | A1 | 6/2007 | Goodman et al. | |
| 2008/0257616 | A1 | 10/2008 | Olsson | |
| 2008/0269986 | A1 | 10/2008 | Regnell et al. | |
| 2008/0309157 | A1 | 12/2008 | Runggaldier et al. | |
| 2009/0000833 | A1 | 1/2009 | Dorais et al. | |
| 2009/0007461 | A1 | 1/2009 | Pelletier et al. | |
| 2009/0013562 | A1 | 1/2009 | Pelletier | |
| 2010/0236107 | A1 * | 9/2010 | Kanzler et al. | 37/219 |

FOREIGN PATENT DOCUMENTS

| | | | |
|---|---|---|---|
| CA | 2443765 | A1 | 4/2004 |
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 19629454 | | 1/1998 |
| DE | 10320523 | | 11/2004 |
| EP | 0551160 | A1 | 7/1993 |
| EP | 0719726 | | 7/1996 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | A1 | 1/2008 |
| EP | 1908673 | B1 | 9/2009 |
| EP | 1908672 | B1 | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 58022265 | | 2/1983 |
| JP | 01144287 | | 10/1989 |
| JP | 03182887 | | 8/1991 |
| JP | 7237566 | | 9/1995 |
| JP | 8301580 | | 11/1996 |
| JP | 2002087763 | | 3/2002 |
| WO | WO2005113322 | | 1/2005 |
| WO | WO2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056576 | | 5/2009 |
| WO | WO2009056577 | | 5/2009 |
| WO | WO2009056578 | | 5/2009 |
| WO | WO2009056579 | | 5/2009 |

OTHER PUBLICATIONS

PistenBully Scout brochure, written by Kassbohrer Gelandefahrzeug AG, published in Jan. 2010.

Written Opinion of the International Seaching Authority for International Application No. PCT/IB2010/000299 dated Jul. 6, 2010.

International Search Report for International Application No. PCT/IB2010/000299 dated Jul. 6, 2010.

* cited by examiner

SNOWGROOMER INCLUDING A WINCH ASSEMBLY TO AID HANDLING OF THE SNOWGROOMER ON STEEP SLOPES, AND METHOD OF OPERATING THE WINCH ASSEMBLY

PRIORITY CLAIM

This application is a national stage application of PCT/IB2010/000299, filed on Feb. 17, 2010, which claims the benefit of and priority to Italian Patent Application No. M12009A 000215, filed on Feb. 18, 2009, the entire contents of each are incorporated by reference herein.

BACKGROUND

Certain known snow groomers normally also comprise a tiller for grooming the snow surface of ski slopes; and a shovel for moving masses of snow along ski slopes. When operating the snow groomer on particularly steep ski slopes, the free end of the winch assembly cable is fixed to an uphill anchorage to maneuver the snow groomer with the aid of the winch assembly, to ensure greater safety and prevent the snow groomer from slipping in the event of loss of traction.

Certain known snow groomers, however, fail to provide for adequate cable control. For example, Canadian Patent No. 2,441,650, describes a snow groomer comprising a winch assembly, which in turn comprises a cable guide device comprising movable arms operated by the cable. The movable arms operate an actuator to move the cable guide device in front of the drum, to wind/unwind the cable correctly with respect to the drum.

However, the snow groomer in Canadian Patent No. 2,441,650 fails to eliminate certain drawbacks caused by occasional deviations of the cable, and may result in malfunctioning of the winch assembly and the snow groomer as a whole. Moreover, the arms may jam and produce undue movement of the cable guide device.

The snow groomer in Canadian Patent No. 2,441,650 also fails to perform functions other than positioning the cable with respect to the drum, with all the drawbacks referred to above.

SUMMARY

The present disclosure relates to a snow groomer comprising a winch assembly to aid handling of the snow groomer on steep slopes.

More specifically, in one embodiment, the snow groomer comprises a frame; a control unit; and the winch assembly, which comprises a support structure fixed or connected to the frame, a drum that rotates with respect to the support structure about an axis, a cable wound about the drum, and an actuator assembly for rotating the drum about the axis.

Accordingly, it is an object of the present disclosure to provide a snow groomer designed to eliminate certain of the drawbacks of certain of the known art.

Another object of the present disclosure is to provide a snow groomer designed to improve cable control.

According to one embodiment of the present disclosure, there is provided a snow groomer comprising a winch assembly to aid handling of the snow groomer on steep slopes, the snow groomer comprises a frame; a control unit; and the winch assembly which comprises a support structure fixed or connected to the frame, a drum that rotates with respect to the support structure about an axis, a cable wound about the drum, an actuator assembly for rotating the drum about the axis, and a sensor for determining the position of the drum about the axis; the control unit being configured to control the cable as a function of the position of the drum and the geometry of the drum.

It is thus possible to control the actual amount of cable wound/unwound on/off the drum, and determine the area of the drum the cable is wound/unwound on/off, and therefore the position the cable should assume with respect to the drum, especially when winding the cable.

In one embodiment of the present disclosure, the winch assembly comprises a cable guide device movable with respect to the drum to position the cable in a given or designated position with respect to the drum; and an actuator for moving the cable guide device with respect to the drum; the control unit being configured to calculate a position of the cable guide device as a function of the position of the drum and the geometry of the drum, and to control the actuator as a function of the calculated position.

The cable is thus wound and unwound correctly in a spiral about the drum.

In another embodiment of the present disclosure, the winch assembly comprises at least one idle pulley, which is positioned contacting the cable and rotated by the cable; and a sensor for determining the position of the idle pulley; the control unit being configured to acquire the rotation speed of the drum and the rotation speed of the idle pulley, and to control the actuator assembly as a function of the rotation speed of the drum, the rotation speed of the idle pulley, the position of the drum, and the geometry of the idle pulley and the drum.

It is thus possible to determine correct tensioning of the cable. If the cable is not tensioned properly, it loses grip on the idle pulley, which therefore does not rotate about its axis. If the cable is not kept taut, it may rewind incorrectly or even unwind automatically off the drum due to its own elasticity.

Another object of the present disclosure is to provide a method of operating a snow groomer winch assembly.

According to one embodiment of the present disclosure, there is provided a method of operating a winch assembly to aid handling of a snow groomer on steep slopes, the winch assembly comprising a support structure; a drum that rotates with respect to the support structure about an axis; and a cable wound about the drum; the method comprising the steps of determining the position of the drum about the axis; and controlling the cable as a function of the determined position of the drum and the geometry of the drum.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
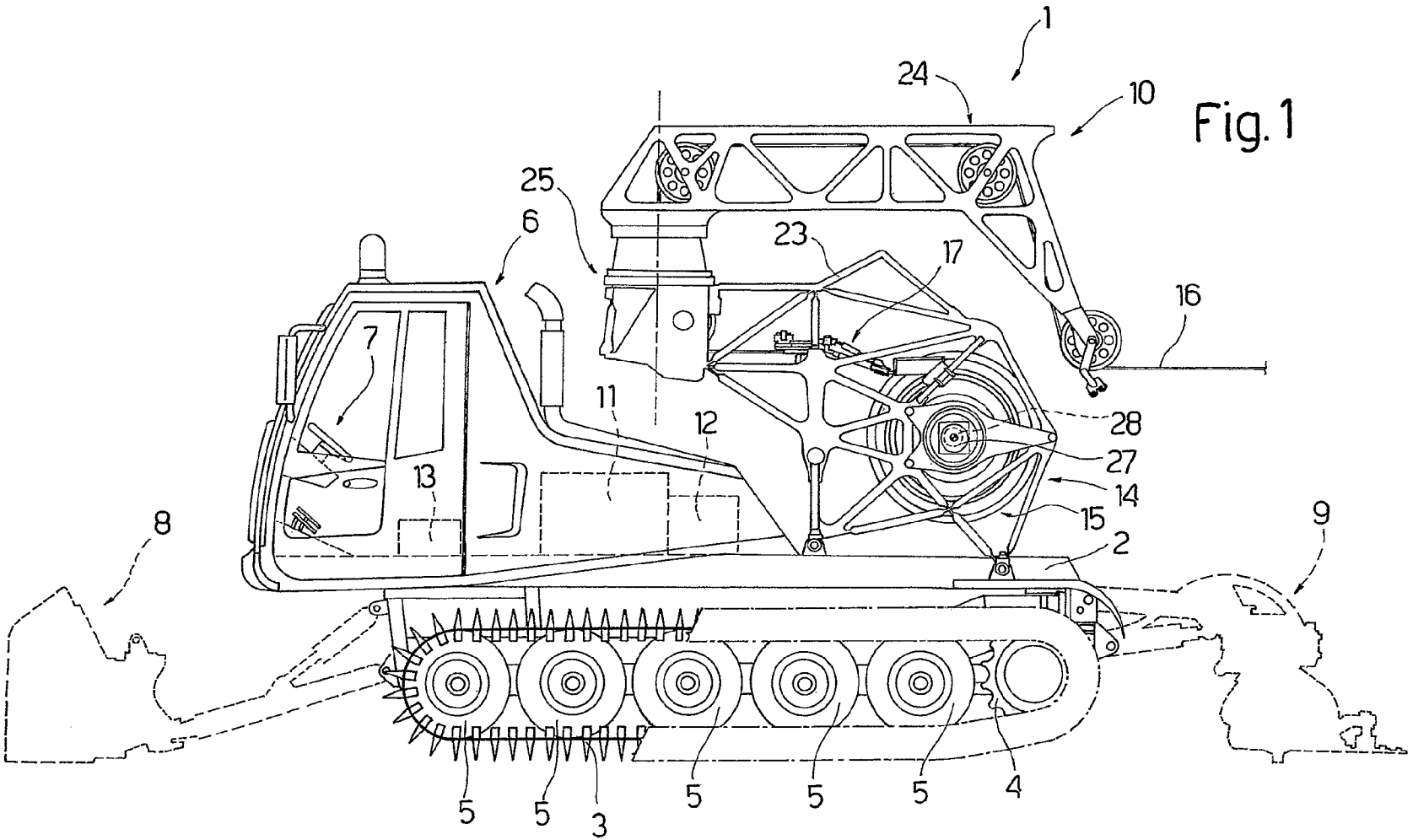
FIG. 1 shows a side view, with parts removed for clarity, of a snow groomer in accordance with one embodiment of the present disclosure.

Referring now to the example embodiments of the present disclosure illustrated in FIGS. 1 to 4, number 1 in FIG. 1 indicates as a whole a ski slope snow groomer.

Snow groomer 1 comprises a frame 2; two crawlers 3 (only one shown in FIG. 1); two drive wheels 4 (only one shown in FIG. 1) connected functionally to respective crawlers 3; idle wheels 5 supporting crawlers 3; a cab 6; a user interface 7 in cab 6; a shovel 8 fitted to the front of frame 2; a tiller 9 fitted to the rear of frame 2; a winch assembly 10 fixed or connected on top of frame 2; an internal combustion engine 11; and a power transmission 12 connected functionally to internal combustion engine 11, drive wheels 4, shovel 8, tiller 9, and winch assembly 10. In different embodiments, power transmission 11 may be hydraulic, electric, or a combination of the two.

Snow groomer 1 comprises a control unit 13 connected to user interface 7 and for controlling snow groomer 1 and winch assembly 10.

Figure 2:
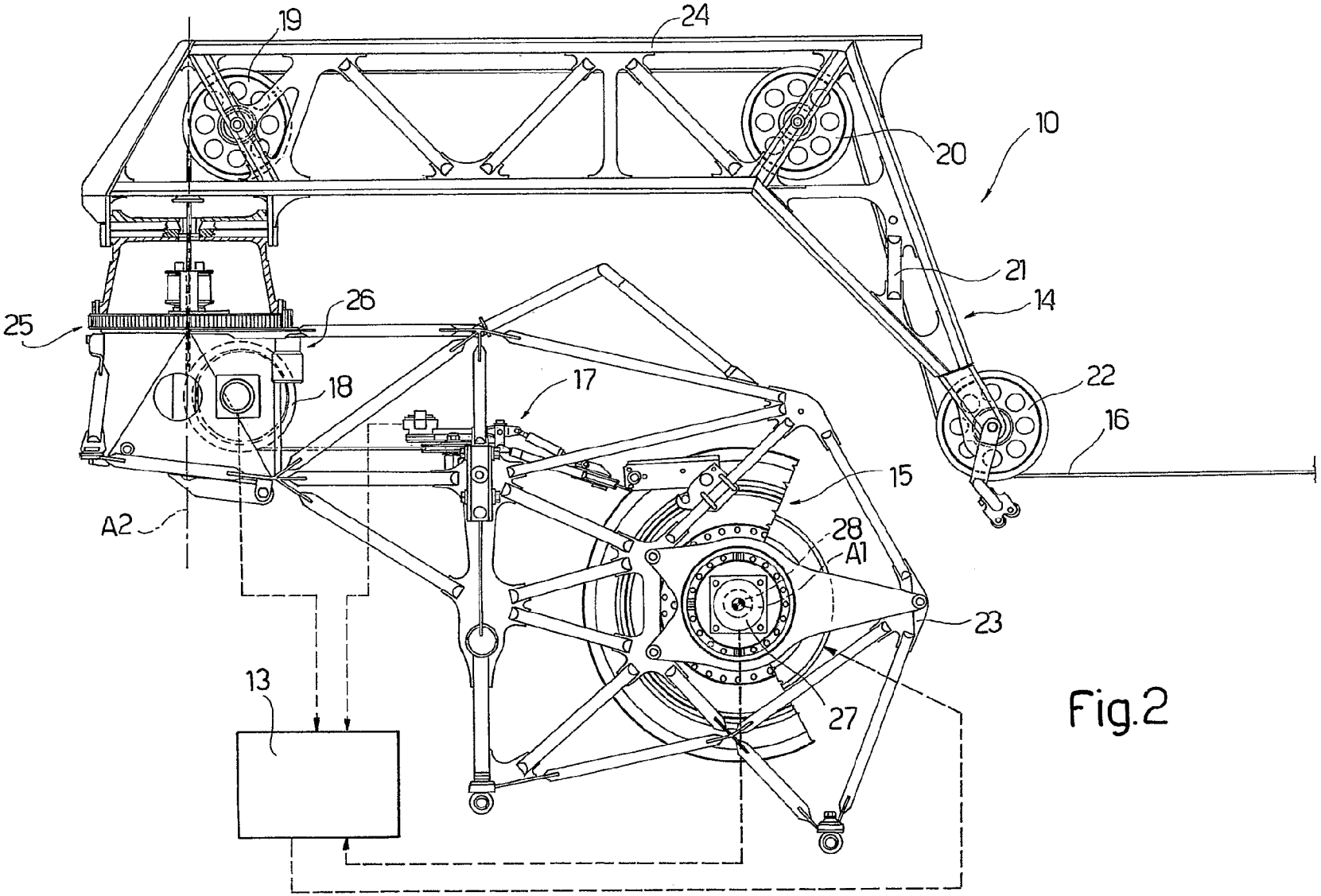
FIG. 2 shows a larger-scale side view, with parts removed for clarity, of a detail of the FIG. 1 snow groomer.

With reference to FIG. 2, winch assembly 10 comprises a support structure 14 fixed or connected to frame 2; a drum 15 fitted to support structure 14 to rotate about an axis A1; a cable 16 fixed or connected at one end to drum 15 and wound about drum 15; a cable guide device 17 movable with respect to drum 15 to position cable 16 with respect to drum 15 when winding/unwinding cable 16 on/off drum 15; and a number or quantity of idle pulleys 18, 19, 20, 21, 22 fitted in rotary manner to support structure 14 to guide cable 16 along a given or designated path along support structure 14.

Support structure 14 includes a lattice structure, and comprises a bottom portion 23 fixed or connected to frame 2 (FIG. 1) and supporting drum 15, cable guide device 17, and idle pulley 18; a top portion 24 that rotates, with respect to bottom portion 23, about an axis A2 crosswise to axis A1; a pivot 25 interposed between bottom portion 23 and top portion 24; and a powered mechanism 26 connected functionally to pivot 25 to selectively rotate top portion 24, with respect to bottom portion 23, about axis A2.

Figure 3:
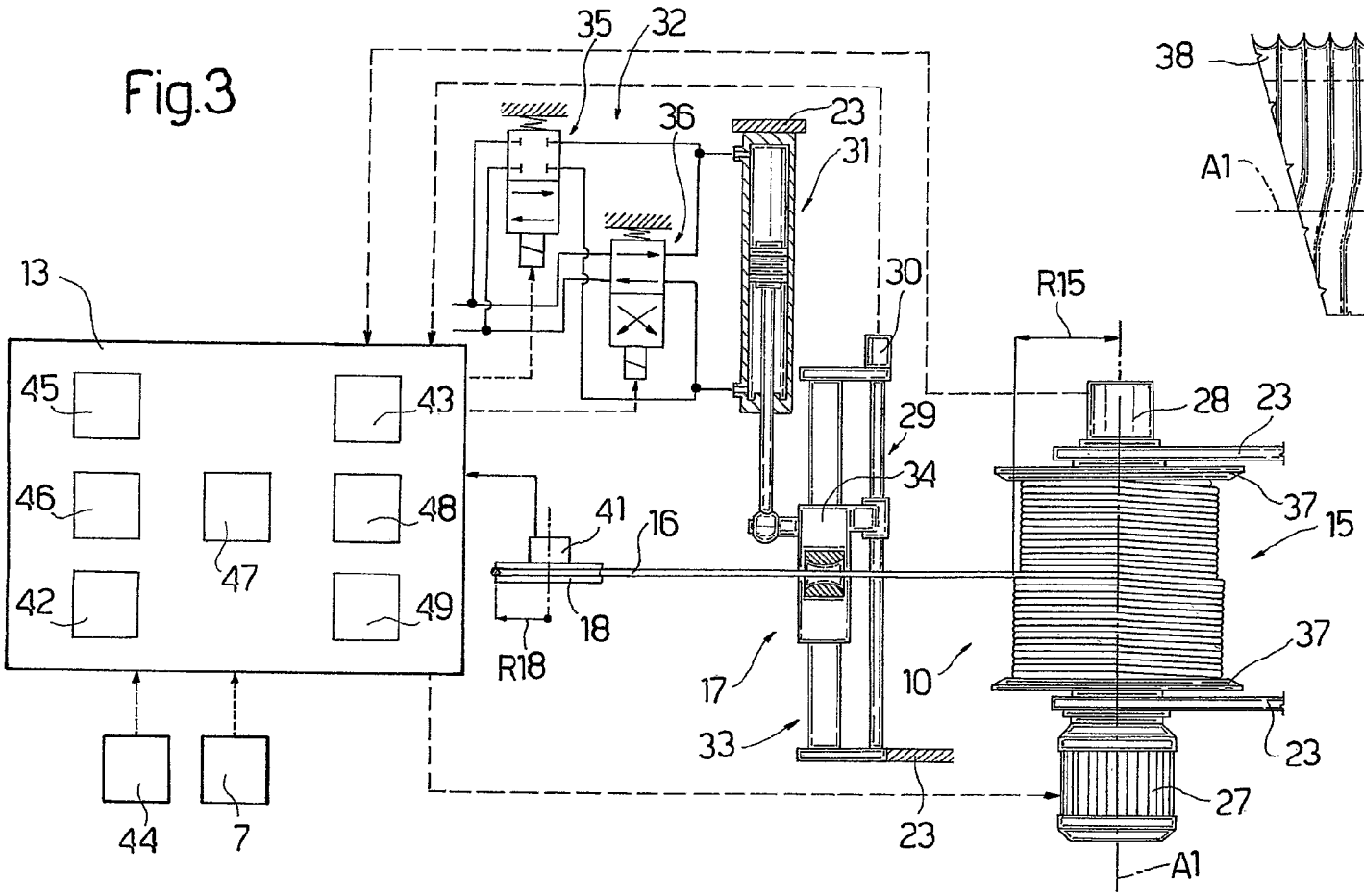
FIG. 3 shows a partly schematic plan view, with parts removed for clarity, of a detail of the FIG. 1 snow groomer.

With reference to FIG. 3, winch assembly 10 comprises an actuator assembly 27 connected functionally to drum 15 to rotate drum 15 in opposite directions about axis A1; a sensor 28 fitted to drum 15 to determine the position of drum 15 about axis A1; a guide mechanism 29 for guiding cable guide device 17; a sensor 30 for determining the position of cable guide device 17 with respect to drum 15; an actuator 31 for moving cable guide device 17 with respect to drum 15; and a control device 32 for controlling actuator 31.

In the FIG. 3 example, guide mechanism 29 for guiding cable guide device 17 comprises a track 33 fitted to bottom portion 23 and parallel to axis A1; and a carriage 34 movable, parallel to axis A1, along track 33 and supporting cable guide device 17. Actuator 31 is a linear actuator—in the example shown, a double-acting hydraulic cylinder fixed or connected to bottom portion 23 of support structure 14 and connected functionally to carriage 34. Control device 32 comprises two solenoid valves 35 and 36.

In an alternative embodiment (not shown in the drawings), the guide mechanism comprises an arm, such as the type described in Canadian Patent No. 2,441,650, that supports the cable guide device and rotates about an axis crosswise to the drum axis.

Figure 4:
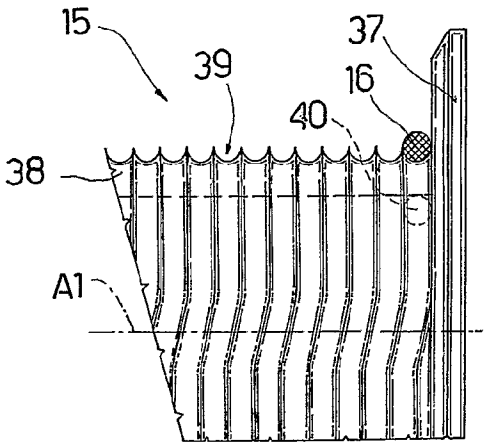
FIG. 4 shows a larger-scale plan view, with parts removed for clarity, of a detail of the FIG. 1 snow groomer.

Drum 15 comprises two flanges 37 perpendicular to axis A1; and, as shown in FIG. 4, a cylindrical wall 38, along which is formed a groove 39 for housing cable 16, which is fixed or connected at one end 40 to cylindrical wall 38.

Groove 39 winds approximately in a spiral along cylindrical wall 38, and is characterized by semicircular portions connected to one another, and by offset portions that produce a shift, in the direction parallel to axis A1, equal to half the pitch of groove 39. A groove 39 of the above type is generally referred to as a Lebus.

Cable 16 is wound in a spiral about drum 15. That is, a first layer of cable 16 is wound partly inside groove 39, and further layers of cable 16 are wound, with the same pitch as groove 39, over the first layer.

As shown in FIG. 3, winch assembly 10 comprises a sensor 41 for determining the position of idle pulley 18.

Control unit 13 is configured to control cable 16, in particular the position of cable 16 with respect to drum 15, and the tension of cable 16, and comprises a memory 42, in which the geometry of drum 15 and the geometry of idle pulley 18 are stored. Control unit 13 is configured to control cable 16 as a function of the position of drum 15 and the geometry of drum 15, which includes the type of groove 39, the dimensions of drum 15 and groove 39, and the number or quantity of winding layers of cable 16. Control unit 13 is connected to user interface 7 to enter data into memory 42.

The position of drum 15 is intended as the absolute position with respect to a zero reference point, in which drum 15 is in a predetermined winding condition, such as with cable 16 fully wound.

On the basis of this information, control unit 13 is configured to control the position of cable guide device 17 as a function of a calculated position, and accordingly comprises a computing block 43 to calculate the position of cable guide device 17 with respect to drum 15.

On the basis of the signal emitted by sensor 28, and of the geometry of drum 15, the winding state of drum 15 can be displayed on a display 44 in cab 6 (FIG. 1).

Once the position of cable guide device 17 is calculated, control unit 13 operates control device 32 to command actuator 31 to set cable guide device 17 to the calculated position.

Control unit 13 also comprises a comparing block 45 to compare the actual position of cable guide device 17 with the calculated position. The actual position is determined by sensor 30. When the difference between the actual position and the calculated position exceeds a given or designated acceptance range, control unit 13 is configured to correct the actual position of cable guide device 17.

Control unit 13 comprises two differentiating blocks 46, 47 to acquire the rotation speed of drum 15 and the rotation speed of idle pulley 18 as a function of the respective positions determined by sensors 28 and 41; a computing block 48 to convert the rotation speeds of drum 15 and idle pulley 18 to respective tangential speeds as a function of the geometry of drum 15, the geometry of idle pulley 18, and the absolute position of drum 15; and a comparing block 49 to determine whether the difference between the tangential speeds exceeds a given or designated threshold value. In which case, control unit 13 is configured to stop drum 15, if drum 15 is unwinding cable 16.

In the absence of slippage between cable 16 and idle pulley 18, the speeds tangential to idle pulley 18 and drum 15 are equal, according to the equation:

$$\omega 18 * R18 = \omega 15 * R15$$

where:

- ω18 is the rotation speed of idle pulley 18;
- R18 is the radius of idle pulley 18;
- ω15 is the rotation speed of drum 15;
- R15 is the radius on which cable 16 is wound, and which in turn is a function of the absolute position of drum 15.

Put briefly, the comparison may be of the type: $\omega 18 < K(\omega 15 * R15)/R18$, where K is an acceptance factor.

Cable tension control is actually also a function of the absolute position of drum 15.

The present disclosure thus provides for a snow groomer capable of precise and also highly versatile winch assembly cable control. The snow groomer, in fact, is capable of controlling the position of the cable along the drum when winding and unwinding the cable; controlling cable tension; and providing the user with a cable winding/unwinding status display.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims

The invention claimed is:

1. A snow groomer comprising:

a frame; and a winch assembly including:

a support structure connected to the frame, a drum configured to rotate with respect to the support structure about an axis, a cable wound about the drum, an actuator assembly configured to rotate the drum about the axis, a first sensor configured to determine a position of the drum about the axis;

at least one idle pulley which is positioned contacting said cable and rotated by said cable, and a second sensor configured to determine a position ion of the at one idle pulley, and a control unit configured to:

acquire a rotation speed of the drum, acquire a rotation speed of the at least one idle pulley, control the cable as a function of the position of the drum and at least one selected from the group consisting of: a dimension of the drum, a quantity of layers of cable wound about the drum, a type of groove formed by the drum, and a dimension of the groove, and control the actuator assembly as a function of: (i) the rotation speed of the drum (ii) the rotation seed of the at least one idle pulley, (iii) the position of the drum, (iv) at least one selected from the group consisting of: a position of the at least one idle pulley and a dimension of the at least one idle pulley, and (v) at least one selected from the group consisting of: the dimension of the drum, the quantity of layers of cable wound about the drum, the type of groove formed by the drum, and the dimension of the groove.

2. The snow groomer of claim 1, wherein:

the winch assembly includes:

a cable guide device movable with respect to the drum to position the cable in a designated position with respect to the drum, and an actuator configured to move the cable guide device with respect to the drum, and said control unit is configured to:

calculate a position of said cable guide device as a function of the position of the drum and at least one selected from the group consisting of: the dimension of the drum, the quantity of layers of cable wound about the drum, the type of groove formed by the drum, and the dimension of the groove, and control the actuator as a function of the calculated position.

3. The snow groomer of claim 2, wherein:

the winch assembly includes third sensor configured to determine an actual position of the cable guide device with respect to the drum, and the control unit is configured to:

compare the actual position and the calculated position, and correct the actual position when a difference between the actual position and the calculated position exceeds a designated acceptance range.

4. The snow groomer of claim 3, which includes a guide configured to guide the cable guide device, the guide including a track and a carriage which is: (i) slideably fitted to the track, (ii) connected to the cable guide device, and (iii) functionally connected to the actuator.

5. The snow groomer of claim 4, wherein the track is parallel to said axis.

6. The snow groomer of claim 1, wherein the control unit includes a memory configured to store at least one selected from the group consisting of: the dimension of the drum, the quantity of layers of cable wound about the drum, the type of groove formed by the drum, and the dimension of the groove.

7. The snow groomer of claim 1, wherein the control unit includes a memory configured to store: (i) at least one selected from the group consisting of: the dimension of the drum, the quantity of layers of cable wound about the drum, the type of groove formed by the drum, and the dimension of the groove, and (ii) at least one selected from the group consisting of: the position of the at least one idle pulley and the dimension of the at least one idle pulley.

8. The snow groomer of claim 1, wherein the winch assembly is configured to aid handling of the snow groomer on steep slopes.

9. A snow groomer winch assembly comprising:

a support structure connected to a frame of a snow groomer, a drum configured to rotate with respect to the support structure about an axis, a cable wound about the drum, an actuator assembly configured to rotate the drum about the axis, and a first sensor configured to determine a position of the drum about the axis, at least one idle le which is positioned contacting said cable and rotated b said cable, a second sensor configured to determine the position of the at least one idle pulley, and a control unit configured to:

(i) acquire a rotation speed of the drum, (ii) acquire a rotation speed of the at least one idle pulley, (iii) control the cable as a function of the position of the drum and at least one selected from the group consisting of: a dimension of the drum, a quantity of layers of cable wound about the drum, a type of groove formed by the drum, and a dimension of the groove, and (iv) control the actuator assembl as a function of: (a) the rotation speed of the drum, (b) the rotation speed of the at least one idle pulley, (c) the position of the drum (d) at least one selected from the group consisting of: a position of the at least one idle pulley and a dimension of the at least one idle pulley, and (e) at least one selected from the group consisting of: the dimension of the drum, the quantity of a layers of cable wound about the drum, the type of groove formed by the drum, and the dimension of the groove.

10. The snow groomer winch assembly of claim 9, which includes a cable guide device movable with respect to the drum to position the cable in a designated position with respect to the drum, and an actuator configured to move the cable guide device with respect to the drum, wherein said control unit is configured to:

(i) calculate a position of said cable guide device as a function of the position of the drum and at least one selected from the group consisting of: the dimension of the drum, the quantity of layers of cable wound about the drum, the type of groove formed by the drum, and the dimension of the groove, and (ii) control the actuator as a function of the calculated position.

11. The snow groomer winch assembly of claim 10, which includes a third sensor configured to determine an actual position of the cable guide device with respect to the drum, wherein the control unit is configured to: (i) compare the actual position and the calculated position, and (ii) correct the actual position when a difference between the actual position and the calculated position exceeds a designated acceptance range.

12. The snow groomer winch assembly of claim 11, which includes a guide configured to guide the cable guide device, the guide including a track and a carriage which is: (i) slideably fitted to the track, (ii) connected to the cable guide device, and (iii) functionally connected to the actuator.

13. The snow groomer winch assembly of claim 12, wherein the track is parallel to said axis.

14. A method of operating a winch assembly to aid handling of a snow groomer on steep slopes, the winch assembly including a support structure, a drum configured to rotate with respect to the support structure about an axis, and a cable wound about the drum, the method comprising:

determining a position of the drum about the axis, acquiring a rotation speed of the drum, acquiring a rotation speed of at least one idle pulley which is positioned contacting the cable and is rotated b the cable, controlling the cable as a function of the determined position of the drum and at least one selected from the group consisting of: a dimension of the drum, a quantity of layers of cable wound about the drum, a type of groove formed by the drum, and a dimension of the groove, and controlling an actuator assembly as a function of: (i) the rotation speed of the drum (ii) the rotation speed of the at least one idle pulley, (iii) the position of the drum, (iv) at least one selected from the group consisting of: the dimension of the drum, the quantity of layers of cable wound about the drum, the type of groove formed by the drum, and the dimension of the groove, and (v) at least one selected from the group consisting of: a position of the at least one idle pulley and a dimension of the at least one idle pulley.

15. The method of claim 14, which includes:

calculating a position of a cable guide device as a function of the determined position of the drum and at least one selected from the group consisting of: the dimension of the drum, the quantity of layers of cable wound about the drum, the type of groove formed by the drum, and the dimension of the groove, and controlling the position of the cable guide device as a function of the calculated position.

16. The method of claim 15, which includes:

determining an actual position of the cable guide device with respect to the drum, comparing the actual position of the cable guide device and the calculated position of the cable guide device, and correcting the actual position of the cable guide device when the difference between the actual position and the calculated position exceeds a designated acceptance range.

17. The method of claim 14, which includes stopping the drum when the rotation speed of the at least one idle pulley is below a reference parameter which is a function of: (i) the rotation speed of the drum, (ii) at least one selected from the group consisting of: the dimension of the drum, the quantity of layers of cable wound about the drum, the type of groove formed by the drum, and the dimension of the groove, and (iii) at least one selected from the group consisting of: the position of the at least one idle pulley and the dimension of the at least one idle pulley.

* * * * *